US010441835B2

(12) United States Patent
Brooks et al.

(10) Patent No.: US 10,441,835 B2
(45) Date of Patent: Oct. 15, 2019

(54) FLOW RESISTANCE INCREASING SWIM WEAR

(71) Applicants: Demeatrice Deniro T. Brooks, Belleville, MI (US); Douglas MacArthur Brooks, Washington, DC (US)

(72) Inventors: Demeatrice Deniro T. Brooks, Belleville, MI (US); Douglas MacArthur Brooks, Washington, DC (US)

( * ) Notice: Subject to any disclaimer, the term of this patent is extended or adjusted under 35 U.S.C. 154(b) by 231 days.

(21) Appl. No.: 15/660,517

(22) Filed: Jul. 26, 2017

(65) Prior Publication Data

US 2018/0008858 A1 Jan. 11, 2018

Related U.S. Application Data

(63) Continuation-in-part of application No. 14/791,392, filed on Jul. 3, 2015, now abandoned.

(60) Provisional application No. 62/020,462, filed on Jul. 3, 2014.

(51) Int. Cl.

| | |
|---|---|
| ***A63B 21/008*** | (2006.01) |
| ***A41D 7/00*** | (2006.01) |
| ***A63B 31/00*** | (2006.01) |
| ***A63B 21/00*** | (2006.01) |

(52) U.S. Cl.

CPC ..... *A63B 21/0084* (2013.01); *A41D 7/00* (2013.01); *A63B 21/4007* (2015.10); *A63B 31/00* (2013.01)

(58) Field of Classification Search

CPC ..... A63B 21/0084; A63B 69/19; A63B 69/12; A63B 21/4007; A63B 31/00–18; A41D 7/00–008

USPC ..... 2/67

See application file for complete search history.

(56) References Cited

U.S. PATENT DOCUMENTS

| | | | | | |
|---|---|---|---|---|---|
| 1,411,909 | A | * | 4/1922 | Condon | A63B 31/14 441/60 |
| 2,592,087 | A | * | 4/1952 | Wallace | A41D 13/0012 2/247 |
| 4,071,236 | A | * | 1/1978 | Oprean | A41D 7/00 2/67 |
| 4,074,904 | A | * | 2/1978 | Arcidiacono | A63B 31/00 482/55 |
| 4,258,914 | A | * | 3/1981 | Lalli | A63B 21/065 224/219 |
| 4,302,007 | A | * | 11/1981 | Oprean | A63B 69/12 482/111 |
| 4,623,142 | A | * | 11/1986 | MacKechnie | A63B 21/0084 482/111 |
| 5,033,739 | A | * | 7/1991 | MacKechnie | A63B 21/0084 482/111 |
| 5,487,710 | A | * | 1/1996 | Lavorgna | A41D 7/00 2/67 |

(Continued)

FOREIGN PATENT DOCUMENTS

| | | | | |
|---|---|---|---|---|
| WO | WO-2006117827 | A1 * | 11/2006 | A63B 69/12 |
| WO | WO-2010035109 | A1 * | 4/2010 | A41D 7/00 |

*Primary Examiner* — Nyca T Nguyen
(74) *Attorney, Agent, or Firm* — Vincent Re PLLC

(57) ABSTRACT

A device to aid a swimmer in training includes a piece of swimwear and a plurality of flow resistance increasing structures attached to the swimwear. The flow resistance increasing structures include a fill material constructed with a polymerized, monofilament material. The polymerized, monofilament material can include tulle.

20 Claims, 7 Drawing Sheets

(56) References Cited

U.S. PATENT DOCUMENTS 5,702,331 A * 12/1997 Perham ..... A63B 21/0084 441/129
6,436,014 B1 * 8/2002 Cirjak ..... A63B 21/0606 446/26
6,955,577 B1 * 10/2005 Hall ..... B63B 35/7906 441/65
8,341,765 B2 * 1/2013 Brodbeck ..... A41D 7/00 2/67
2004/0197754 A1 * 10/2004 Coppelli ..... A63B 69/12 434/254
2004/0221355 A1 * 11/2004 Garcia ..... A41D 7/00 2/67
2005/0215135 A1 * 9/2005 Hall ..... B63B 35/7906 441/55
2007/0049141 A1 * 3/2007 Staver ..... A41D 7/001 441/115
2007/0256206 A1 * 11/2007 Nilsen ..... A63B 21/065 2/69
2008/0078008 A1 * 4/2008 Demarest ..... A41D 7/00 2/115
2010/0197468 A1 * 8/2010 Zhang ..... A63B 21/0084 482/55
2011/0167533 A1 * 7/2011 Stewart ..... A63B 21/0601 2/102
2012/0053021 A1 * 3/2012 Sherstnev ..... A63B 69/12 482/55
2012/0266347 A1 * 10/2012 DiLorenzo ..... A41D 7/00 2/67
2013/0298302 A1 * 11/2013 Whaley ..... A41D 1/00 2/69
2014/0038791 A1 * 2/2014 Bell ..... A63B 21/00069 482/111
2014/0302970 A1 * 10/2014 Sinclair ..... A63B 21/065 482/105
2016/0001156 A1 * 1/2016 Brooks ..... A63B 69/12 2/67
2016/0008206 A1 * 1/2016 Devanaboyina ..... A47C 9/002 601/136
2017/0095018 A1 * 4/2017 Bruce ..... A61B 42/10
2017/0252601 A1 * 9/2017 McKenzie ..... A41D 13/0015
2018/0008858 A1 * 1/2018 Brooks ..... A41D 7/001
2018/0369632 A1 * 12/2018 Peloquin ..... A63B 31/10

* cited by examiner

FLOW RESISTANCE INCREASING SWIM WEAR

CROSS REFERENCE TO RELATED APPLICATIONS

This disclosure is a continuation-in-part of U.S. patent application Ser. No. 14/791,392 filed on Jul. 3, 2015 which claims the benefit of U.S. Provisional Application No. 62/020,462, filed on Jul. 3, 2014, both of which are hereby incorporated by reference.

TECHNICAL FIELD

This disclosure is related to a swimsuit equipped with features configured to increase water resistance of a swimsuit worn by a swimmer as he or she trains for competitive races.

BACKGROUND

The statements in this section merely provide background information related to the present disclosure. Accordingly, such statements are not intended to constitute an admission of prior art.

The best way to build a swimmer's strength and power, besides training on dry land in a gym or weight room, is through resistance training in the water, using the same muscles that will be used during competition. Once a swimmer has mastered the correct technique, it is important to improve their strength and muscular endurance in order to improve. Muscle strength is developed by breaking down the muscle through slight over-exertion, followed by rest, and then during this resting cycle, the body rebuilds the muscle slightly stronger. Strength in the corresponding muscle groups increases swimming performance and efficiency. The goal of a swimmer is to travel the most distance with the least amount of strokes, a skill measured as "DPS" (distance per stroke). When a swimmer has a more powerful stroke, each stroke propels the swimmer further and faster.

Past methods to increase in water resistance while swimming have varied from wearing bulky clothing including open pockets to pulling buoys.

SUMMARY

A device is disclosed to aid a swimmer in training. The device includes a piece of swimwear and a plurality of flow resistance increasing structures attached to the swimwear. The flow resistance increasing structure include a fill material constructed with a polymerized, monofilament material. The polymerized, monofilament material can include tulle.

BRIEF DESCRIPTION OF THE DRAWINGS

One or more embodiments will now be described, by way of example, with reference to the accompanying drawings, in which:

FIG. 3A illustrates a material block 30 in a semi cylindrical shape, including a half circle cross-section;

FIG. 3B illustrates a material block in a cylindrical shape, including a circular cross-section; and FIG. 3C illustrates a material block in a triangular cross-section;

DETAILED DESCRIPTION

Figure 1:
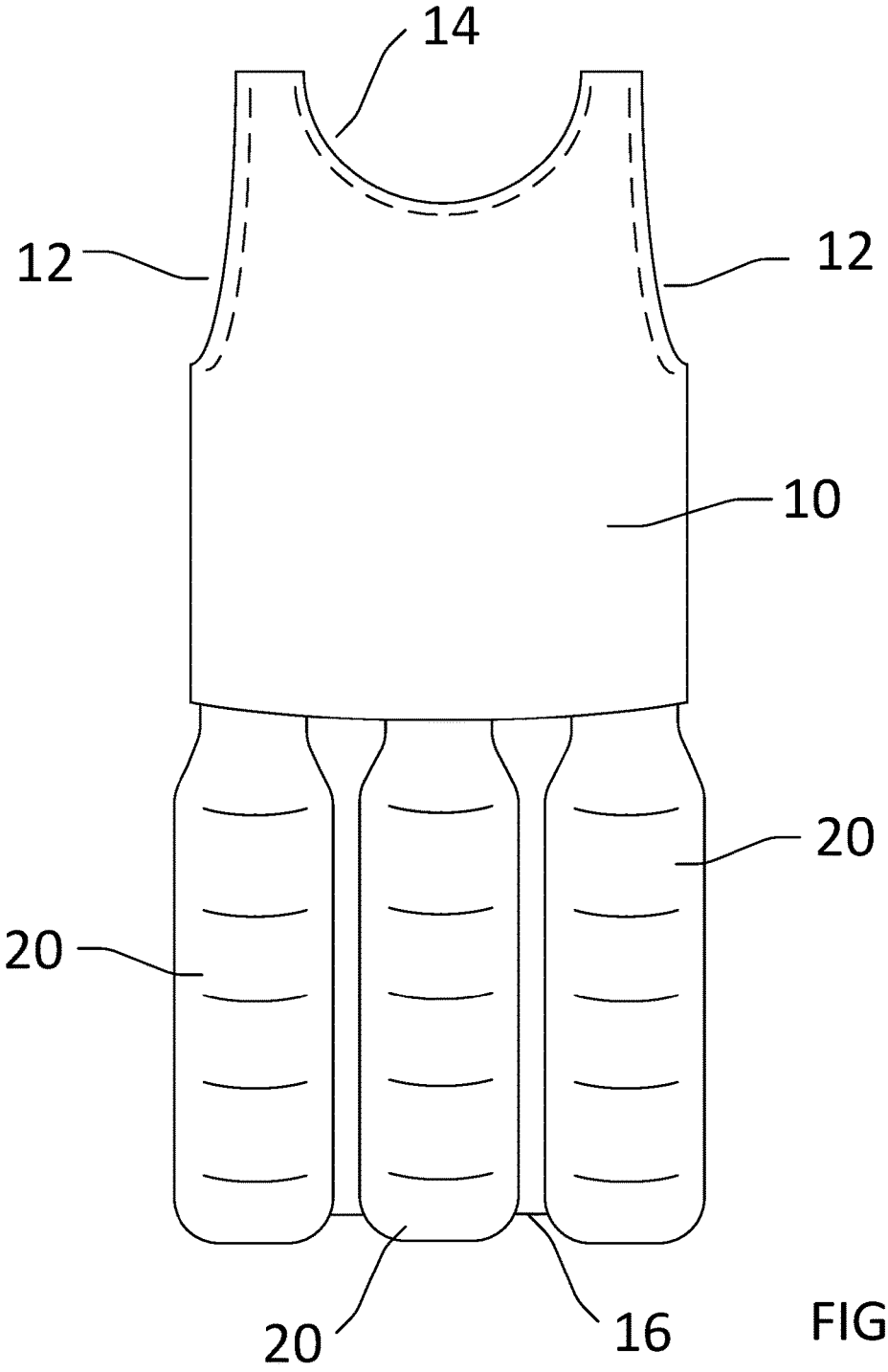
FIG. 1 illustrates an exemplary swimsuit shirt worn by a competitive swimmer during training or practice sessions, in accordance with the present disclosure.

While the wearing of bulky clothing increases the resistance of the swimmer's body as he or she moves through the water, such clothing, not designed for swimming, can be awkward and interfere with practicing proper swimming techniques. Known tethers dragging water-parachutes or buoys that can be dragged or held by the swimming during practice similarly increase resistance but can interfere with practicing proper swimming techniques. Further, a tether attached to a swimmer can be a potential hazard, potentially wrapping around the swimmer. Pockets situated upon clothing are dependent upon the pockets remaining open during swimming and can present variable geometry during swimming, making the resistance to the swimmer variable over time.

A device including a swimming suit with an attached flow resistance increasing structure or structures, providing additional resistance for the swimmer moving through the water, is provided. In some embodiments, a floatation device or devices can additionally be attached to the shirt to provide additional buoyancy and resistance to the user. The swimsuit can take many forms including a swimming shirt or a one-piece swimsuit.

Resistance increasing structures can take a number of forms. For example, a block of material can be attached to the suit. Such a block and exist in a number of forms and shapes, including structures in line with a flow direction of water going over the suit, perpendicular to the flow direction of the water, or any other shape configured to increase flow resistance. Such material can include water absorbent material such as a sponge or water repellent material such as closed cell polymer foam. In another exemplary embodiment, a resistance increasing structure can include a semi-cylindrical resistance tube or a plurality of tubes oriented in the direction of the swimmer's forward progress or the direction of forward progress can be utilized. Such tubes can be aligned such that the straight sides of the semi-cylindrical shape are parallel to the direction of flow/swimming motion. The sponge or foam material can be simply attached to the suit, with the surface of the material visible to an outer surface of the swim suit or swimming shirt. In another embodiment, the material can be encased or covered by a layer of material known for use with a swim suit or swimming shirt.

Sponges or foam can be used that float or increase buoyancy of the swimmer. Any known material useful as a floatation device can be attached to the shirt or sewn upon the shirt with a cloth or mesh covering over the device. In other embodiment, the sponge or foam material can be neutrally buoyant, neither making the swimmer more likely to sink or float.

Various types of swim wear are envisioned for use with the resistance increasing training aids disclosed herein. While a swimming shirt and a woman's swim suit are illustrated as examples herein, the disclosure is intended to include any type of swim wear, including men's swim shorts, Olympic-style full body suits, or elastic training bands that could be placed over a swimmers arms or legs, and is not intended to be limited to the particular examples provided herein.

Referring now to the drawings, wherein the showings are for the purpose of illustrating certain exemplary embodiments only and not for the purpose of limiting the same, FIG. 1 illustrates a swimming shirt 10 worn by a competitive swimmer during training or practice sessions. Swimming shirt 10 includes holes 12 for the arms of the swimmer, neck hole 14, and bottom opening 16. Swimming shirt 10 is illustrated including a plurality of resistance increasing structures 20 embodied as sponge or foam material encapsulated within a layer of cloth oriented in the direction of flow/swimming direction. Resistance increasing structures 20 can be included an any number upon the shirt, and can be worn only on a front of the shirt, only on a rear of the shirt, or on both a front and a rear of the shirt.

Figure 2:
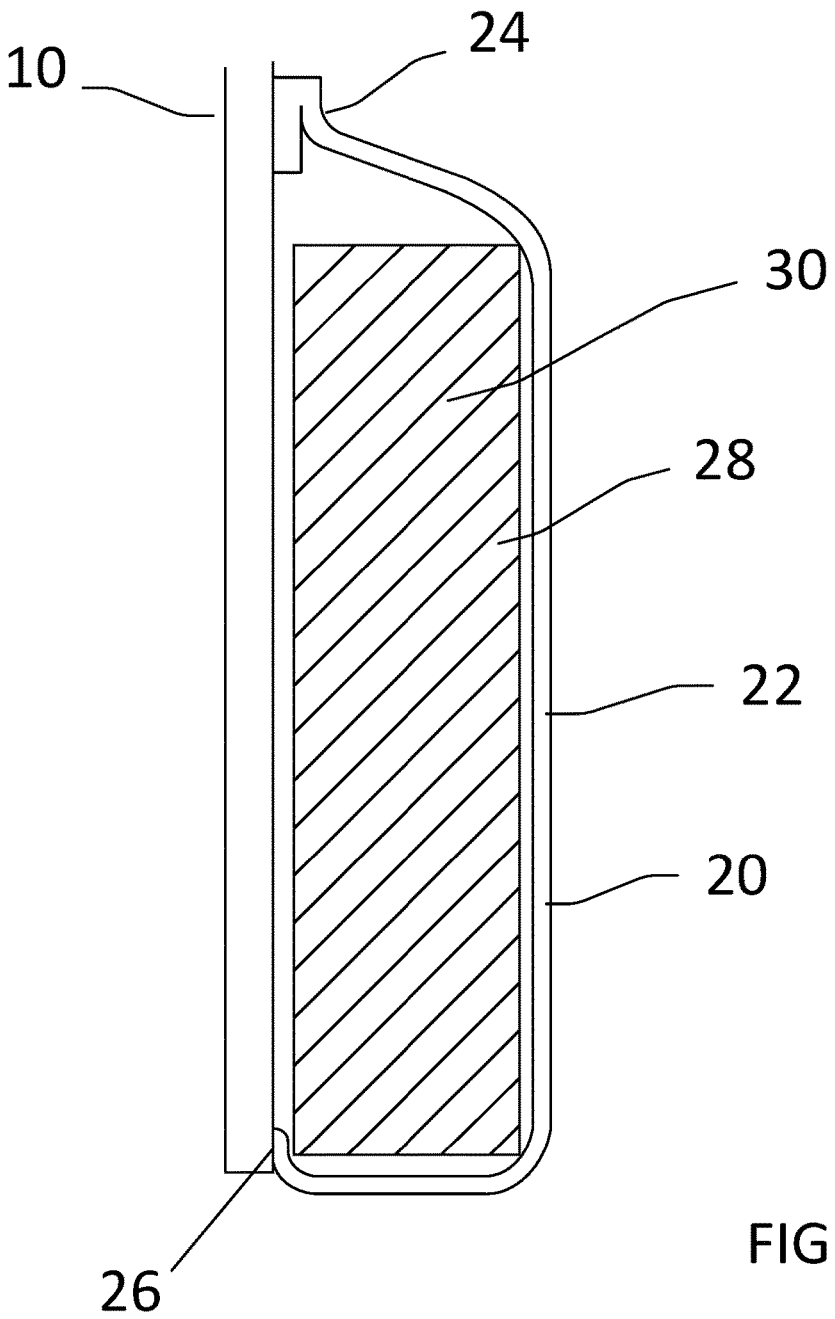
FIG. 2 illustrates a resistance increasing structure of FIG. 1 in cross section, in accordance with the present disclosure.

FIG. 2 illustrates a resistance increasing structure of FIG. 1 in cross section. Swimming shirt 10 is illustrated with resistance increasing structure 20 attached thereto. Material block 30 is illustrated, attached to shirt 10. In the exemplary embodiment of FIG. 2, block 30 is encapsulated within a cavity 28 of cloth material 22, which can be made of the same material as shirt 10. Cloth material 22 is sewn or otherwise attached to shirt 10 at exemplary points 24 and 26, although material 22 is preferably sealed around an entire perimeter to avoid the block 30 from falling away from the shirt.

Figure 3C:
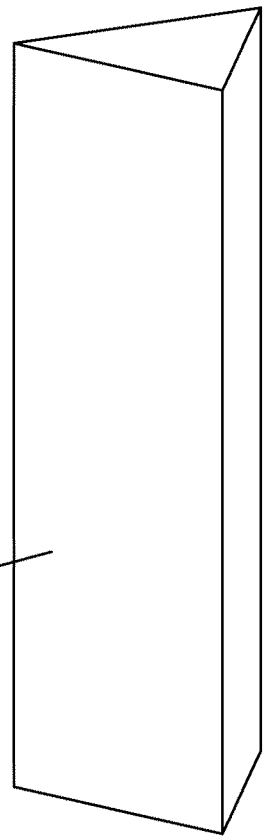
FIG. 3A to 3C illustrate a plurality of exemplary material blocks that can be used with swim wear as disclosed herein, in accordance with the present disclosure.
Figure 3B:
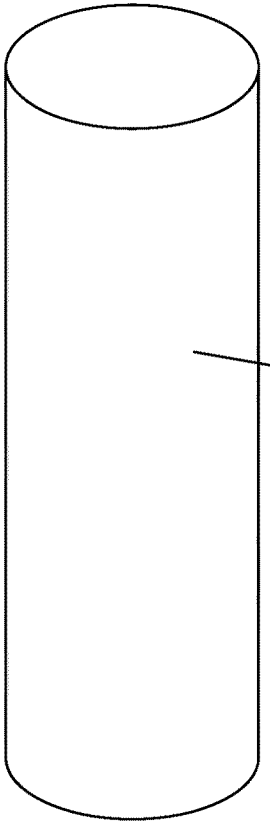
Figure 3A:
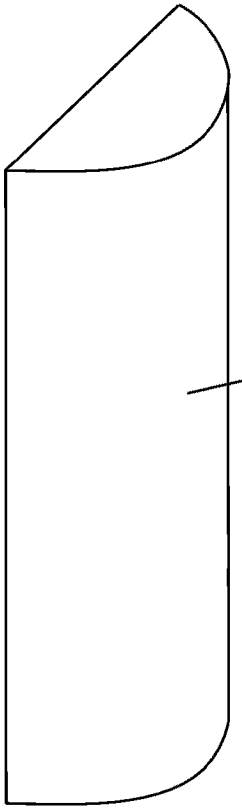

FIG. 3A to 3C illustrate a plurality of exemplary material blocks that can be used with swim wear as disclosed herein. FIG. 3A illustrates material block 30A in a semi cylindrical shape, including a half circle cross-section. FIG. 3B illustrates material block 30B in a cylindrical shape, including a circular cross-section. FIG. 3C illustrates material block 30C in a triangular cross-section. FIGS. 3A-3C are included as non-limiting examples. In other examples, a block can be tapered or wider at one end than another, can be wedge-shaped, or can include a plurality of smaller shapes, such as spheres, contained within an encapsulated cavity (i.e. each small sphere being a block with a plurality of blocks used in a single resistance increasing structure.)

Material blocks can be made of many different materials. The blocks can be made out of common sponge material, absorbing water as the swimming enters the water. In another example, a block can be made of a polyester mesh filler, a cotton pad, or a combination of the two. In another example, the blocks can be made of open cell foam known in the art. Such open cell foam can be porous to absorb water like a sponge, but the material itself can be water repellent or water resistant. Such open cell foams can be nearly dry after a user depresses the foam to squeeze water out of the porous cavities. The blocks can be made of closed cell foam known in the art. Such closed cell foam is lightweight and provides for a rigid shape in the water, while the foam itself does not absorb water. Other materials such as wood, polymer blocks, or blow-molded hollow plastic structures can be used for the material block, as disclosed herein.

Figure 4:
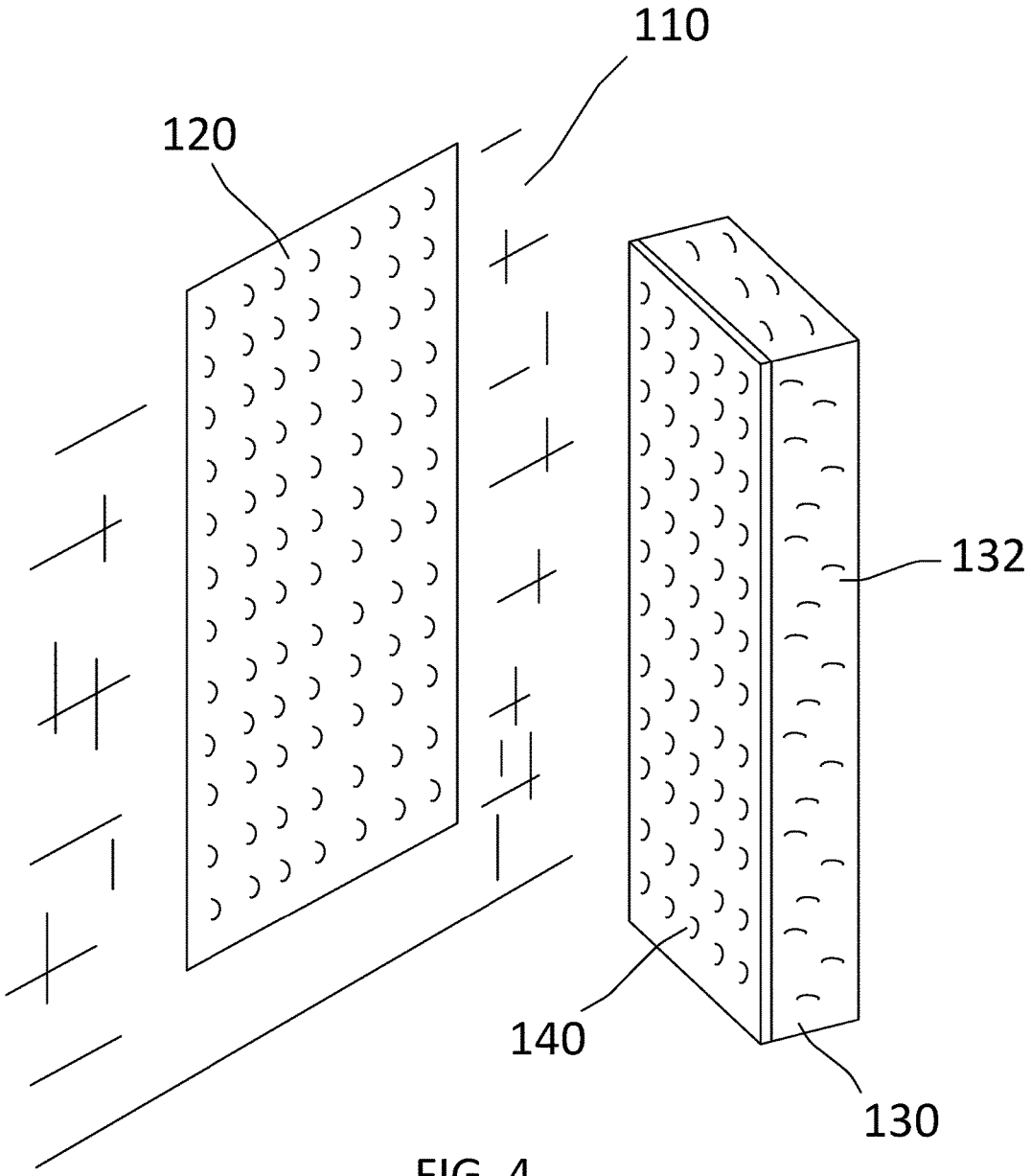
FIG. 4 illustrates an alternative exemplary embodiment of a resistance increasing structure removably attached to a swimming shirt, in accordance with the present disclosure.

FIG. 4 illustrates an alternative exemplary embodiment of a resistance increasing structure removably attached to a swimming shirt. Shirt 110 is illustrated including resistance increasing structure 130. One half 120 of a hook and loop fastener (i.e. Velcro®) patch is illustrated attached to shirt 110, and a second half 140 of the hook and loop fastener is illustrated attached to resistance increasing structure 130 embodied as a rectangular section block of foam. Material blocks can be encased in cloth. In the embodiment of FIG. 4, the material block 132 is exposed directly and visible to the outside of shirt 110. Block 132 is attached to second half 140. By using one or more of such detachable and selectively attachable blocks, a training method is enabled where swimwear with variable resistance can be provided. A swimmer can progress through a training regimen, for example, starting with five resistance increasing structures 130 attached to the swim wear, and, as the swimmer gets closer to a competition, the swimmer can remove one by one the structures 130.

FIG. 4 illustrates removable resistance increasing structures being attached to swim wear with exemplary Velcro® patches. Other mechanisms or structures can be used to removably or selectably attach resistance increasing structures to swim wear. In another non-limiting example, a small metallic ring can be sewn or otherwise attached to a swimming shirt, and a metallic clip attached to a small cloth bag including a material block within the bag can be clipped to the metal ring on the shirt. Metals known in the art for use in a chlorinated swimming pool would be best used with such a metallic fastener to avoid corrosion or discoloration of the device. A number of other buttons, snaps, zippers, and other similar connection mechanisms can be used to attach a resistance increasing structure to swim wear, and the disclosure is not intended to be limited to the particular examples provided herein.

Figure 5:
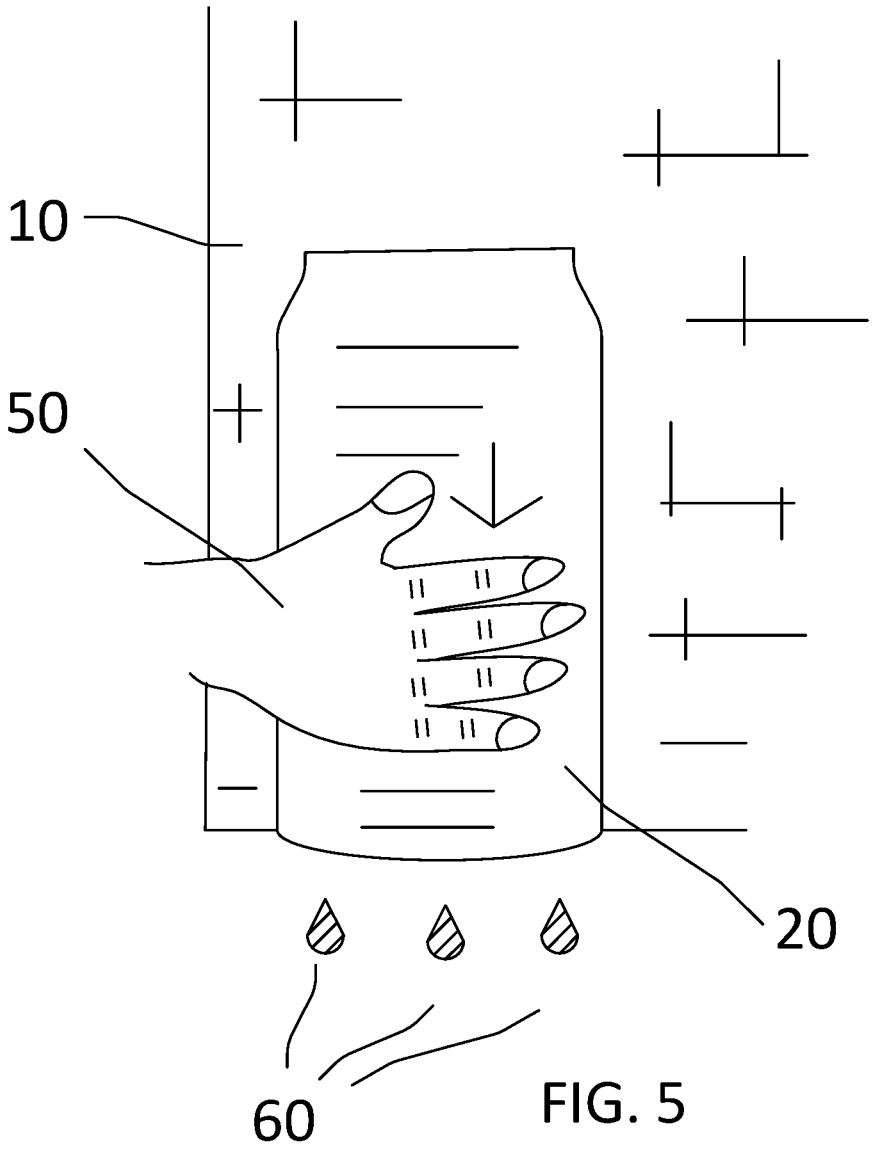
FIG. 5 illustrates a user running a hand over an exemplary resistance increasing structure, where depression of the structure easily releases water from within the structure, in accordance with the present disclosure.

Previous known embodiments of training suits included pockets that increased resistance by including open pockets that trapped water within the pockets. Such pockets can be hazards, wherein every time a swimmer exits the pool, pools of water can be created on a floor around the pool. Such pools of water can be slip hazards. FIG. 5 illustrates a user running a hand over an exemplary resistance increasing structure, where depression of the structure easily releases water from within the structure. Swimming shirt 10 is illustrated including resistance increasing structure 20. Structure 20 includes an absorbent or porous material block. Depression of the block by hand 50 causes water 60 to drain from a bottom of structure 20. In this way, by depressing the structure 20 as the swimmer exits the pool, a swimmer can easily prevent excessive water from being removed from the pool and drained upon a floor next to the pool.

Figure 6:
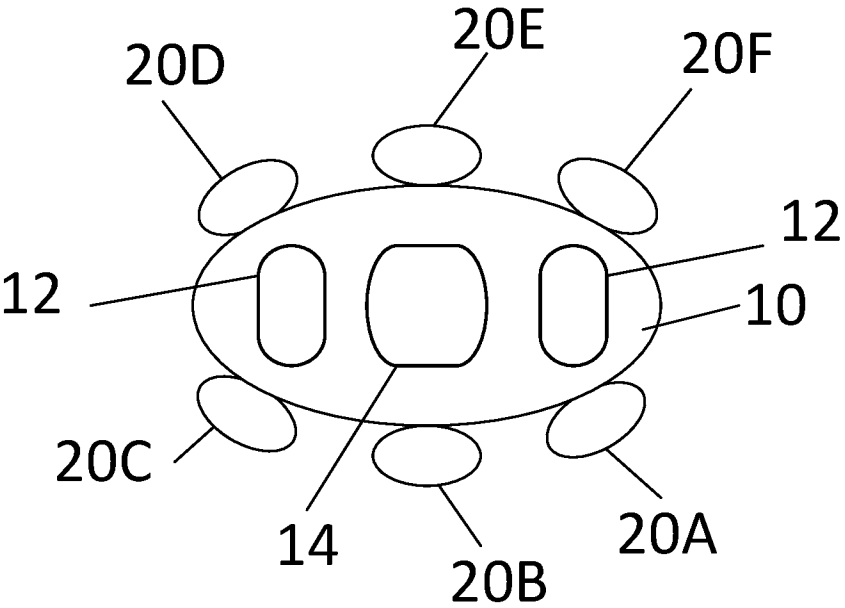
FIG. 6 illustrates from an above view a swimming shirt with a plurality of resistance increasing structures attached thereto, in accordance with the present disclosure.

FIG. 6 illustrates from an above view a swimming shirt with a plurality of resistance increasing structures attached thereto. Swimming shirt 10 is illustrated viewed from above, including holes 12 for arms of a swimmer and neck hole 14. Resistance increasing structures 20A, 20B, 20C, 20D, 20E, and 20F are illustrated attached around a perimeter of the shirt. In one embodiment, all six exemplary structures 20A through 20F can be attached to shirt 10. In another example, only structures 20A through 20C can be attached to the shirt. In another example, only structures 10A, 20C, and 20E can be attached to the shirt. Any number of combinations of resistance increasing structures upon swim wear are envisioned, and the disclosure is not intended to be limited to the particular examples provided herein.

Figure 7:
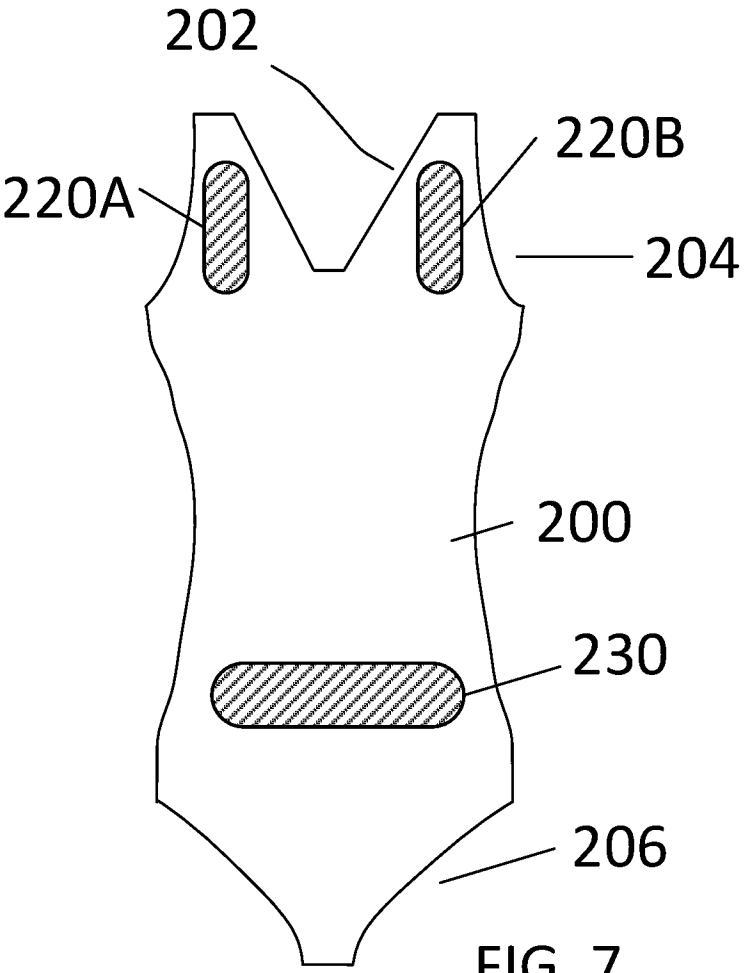
FIG. 7 illustrates an exemplary woman's swimsuit including resistance features, in accordance with the present disclosure.

FIG. 7 illustrates an exemplary woman's swimsuit including resistance features. Women's swimsuit 200 is illustrated including holes 204 for a swimmer's arms, neck hole 202, and holes 206 for a swimmer's legs. Resistance increasing structures as disclosed herein can be worn parallel to a swim direction, perpendicular to a swim direction, or angled with respect to a swim direction. Resistance increasing structures can be worn anywhere on a piece of swim wear. Resistance increasing structures 220A and 220B are illustrated near shoulder straps of the swimsuit 200 parallel to a swim direction. Resistance increasing structure 230 is illustrated attached to swimsuit 200 near a midsection area and oriented perpendicular to a swim direction.

Resistance increasing structures can be sized and situated in any number of configurations. Larger structures are illustrated herein for clarity of the disclosure. However, one could attach thirty smaller structures over a surface of the suit according to the disclosure. One could, in another alternative, attach one large structure to a back of the swimmer.

Figure 8:
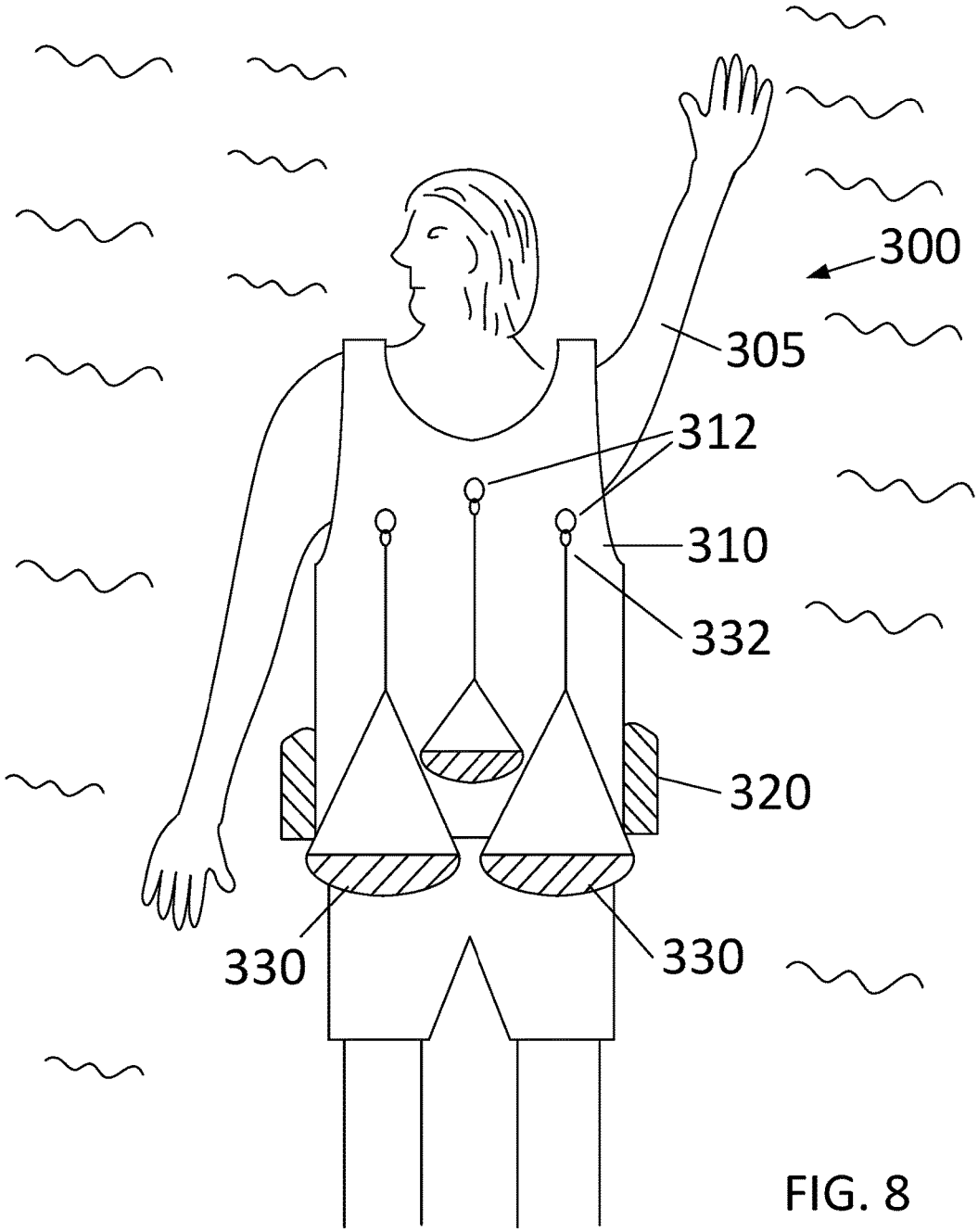
FIG. 8 illustrates an additional resistance feature including a detachable parachute clip that can be added to swim wear, in accordance with the present disclosure.

The increased resistance structures disclosed herein can be used in combination with other flow resistance features. FIG. 8 illustrates an additional resistance feature including a detachable parachute clip that can be added to swim wear. Swimmer 305 is illustrated swimming in pool 300 wearing swimming shirt 310. Shirt 310 including resistance increasing structures 320 additionally includes a plurality of ring clips 312 sewn or otherwise attached to a back of shirt 310. Three parachute devices 330 are illustrated attached to ring clips 312 with clip devices 332. Parachute devices 330 can be made of nylon or any other material known in the art and are configured to open or remain open while the swimmer moves in a forward direction. The open parachutes greatly increase drag or flow resistance in the water. In this way, a swimmer can add additional resistance and have additional training options with the disclosed device.

Referring again to FIG. 1, according to one exemplary embodiment, the outer layer of the jersey is composed of a spandex material, generally found on competitive swimming suits (Spandex®, Lycra®, etc). The inner layer or lining of the jersey can either be spandex or mesh depending on the level of resistance desired for use per version. The material on the shoulders of the jersey width has been cut thin to compliment the swimmer in the water because a lot of regular jerseys can have too much material covering the shoulders and can be damaging to the swimmer and cause injury. The bottom of the jersey which encloses the tubes can be made of tulle or spandex fabric.

Tubes or other structures used on the jersey can be filled with a polymerized, monofilament material, which includes an advantageous property that water drains very quickly from the fill. This is advantageous over sponges or natural threaded materials because the polymerized monofilament does not absorb water, and as soon as the swimmer exits the water, the tubes are almost immediately dry and do not continue to drip on the swimmer's legs for an extended period of time. Polymerized, monofilament materials can include nylon or rayon materials. In one exemplary embodiment, the polymerized monofilament can be formed into a netting material or a grid-shaped mesh. An exemplary polymerized, monofilament netting is provided under the market name tulle. Tulle or a similar material can be used to fill an absorption tube, with the filled tube providing flow resistance to aid in the swimmer's training while advantageously quickly draining when the swimmer leaves the water.

Referring again to FIG. 2, there are six exemplary absorption tubes attached to the jersey with three on the front and three on the back seen on the left figure. These numbers are examples as any number of tubes can be added to the jersey. The material block 30 in FIG. 2 in one embodiment can be composed of packed tulle or similar material and is enclosed in mesh and spandex as cloth material 22. The tulle fills the absorption tubes to capacity. The bottom of the absorption tubes can either have a mesh or spandex. In one embodiment, by having a mesh or tulle material underneath the material block 30, the rapid draining of water from the absorption tube is further facilitated. These tubes are strategically placed from the abdomen to the waistline to ensure an adequate amount of resistance to the summer without damaging their body, feel in the water, and technique while applying drag. The absorption tubes fill with water and the placement and structure allows swimmers to backstroke, breast stroke, butterfly, and freestyle without bringing harm to the shoulders and arms.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A device to aid a swimmer in training, the device comprising:

a swim wear jersey;

at least one material block attached to the swim wear jersey and operable as a flow resistance increasing structure, the material block comprising a fill material constructed with a polymerized, monofilament material operable to facilitate rapid draining of the fill material; and a mesh material underneath the material block configured to facilitate rapid draining of the fill material.

2. The device of claim 1, wherein the material block is removably attached to the swim wear jersey.

3. The device of claim 2, further comprising a plurality of material blocks, each removably attached to the swim wear jersey.

4. The device of claim 1, further comprising a plurality of material blocks attached around a perimeter of the swim wear jersey.

5. The device of claim 1, wherein the material block includes a half circle cross-section.

6. The device of claim 1, wherein the polymerized, monofilament material comprises tulle.

7. The device of claim 4, wherein the plurality of material blocks are oriented in a swim direction.

8. The device of claim 1, wherein the material block includes a circular cross-section.

9. The device of claim 1, wherein the material block includes a triangular cross-section.

10. The device of claim 1, wherein the material block is oriented perpendicular to a swim direction.

11. The device of claim 1, further comprising a detachable parachute device removably attached to a back side of the swim wear jersey.

12. A device to aid a swimmer in training, the device comprising:

a swim wear jersey; and at least one material block attached to the swim wear jersey and operable as a flow resistance increasing structure, the material block comprising a fill material constructed with a polymerized, monofilament material operable to facilitate rapid draining of the fill material; and wherein the material block is encapsulated within cloth attached to the swim wear jersey.

13. The device of claim 12, wherein the polymerized, monofilament material comprises tulle.

14. The device of claim 12, further comprising a plurality of material blocks attached around a perimeter of the swim wear jersey.

15. The device of claim 12, wherein the material block includes a half circle cross-section.

16. The device of claim 12, wherein the material block includes a triangular cross-section.

17. The device of claim 12, wherein the material block is oriented perpendicular to a swim direction.

18. A device to aid a swimmer in training, the device comprising:

a swimsuit including holes for arms of the swimmer, a neck hole, and holes for legs of the swimmer; and at least one material block attached to the swimsuit and operable as a flow resistance increasing structure, the material block comprising a fill material constructed with a polymerized, monofilament material operable to facilitate rapid draining of the fill material; and wherein the fill material is encapsulated within cloth attached to the swimsuit.

19. The device of claim 18, wherein the polymerized, monofilament material comprises tulle.

20. The device of claim 18, further comprising a plurality of material blocks attached around a perimeter of the swimsuit.

* * * * *